United States Patent [19]

Cremer

[11] 4,102,961

[45] Jul. 25, 1978

[54] METHOD FOR THE PRODUCTION OF LARGE-SIZE DENSELY SINTERED CERAMIC PLATES WITH A LOW WALL THICKNESS

[76] Inventor: Gottfried Cremer, Steyrer Weg 6, 5000 Köln-Junkersdorf, Germany

[21] Appl. No.: 779,247

[22] Filed: Mar. 18, 1977

[30] Foreign Application Priority Data

Mar. 29, 1976 [DE] Fed. Rep. of Germany ..... 2613400

[51] Int. Cl.[2] ..... B28B 11/00

[52] U.S. Cl. ..... 264/57; 264/67; 264/151

[58] Field of Search ..... 264/57, 67, 151

[56] References Cited

U.S. PATENT DOCUMENTS 3,651,184 3/1972 Everhart ..... 264/57

FOREIGN PATENT DOCUMENTS 1,708,877 10/1970 Fed. Rep. of Germany ..... 264/67

938,240 10/1963 United Kingdom ..... 264/57

*Primary Examiner*—Thomas P. Pavelko

*Attorney, Agent, or Firm*—Price, Heneveld, Huizenga & Cooper

[57] ABSTRACT

The specification describes a method for the production of densely sintered large ceramic plates of small thickness. The ceramic composition is first extruded by means of an extruder and is then rolled out from the resulting billets in a direction perpendicular to the extrusion axis, this rolling operation is carried out by a further rolling out operation in the axial direction of the billets. The cutting out of the plates to the desired format is by means of a pressing knife acting perpendicularly with respect to the plate plane. Following this the plates are dried and fired.

7 Claims, No Drawings

METHOD FOR THE PRODUCTION OF LARGE-SIZE DENSELY SINTERED CERAMIC PLATES WITH A LOW WALL THICKNESS

BACKGROUND OF THE INVENTION

1. Field to Which the Invention Relates

The invention relates to a method for the production of large-size densely sintered ceramic plates with a low wall thickness in the case of which a ceramic composition is first extruded as billets by means of an extruder to form plates which, after they have been cut to the desired format, are dried and fired.

In connection with the present invention the term ceramic plate is to be taken more particularly to mean a ceramic clay plate.

2. The Prior Art

As is well-known it is extremely difficult to produce ceramic clay sintered plates with a size of 0.5 × 0.5 meters to 2 × 2 meters with a wall thickness of 7 to 12 mm without warping.

The difficulties occuring in the production of thin-walled, large format plates and sheet structures are due substantially to the so-called "memory" or "recollection" of the compositions used. These phenomena occur owing to the loading of the composition during shaping and/or drying and make themselves felt more especially during firing. Thus the ceramic composition "remembers" the forced alignment of the platlet-like particles of clay during shaping and the forced or strained movements of the individual particles and has the tendency to continue this movement or to cancel it out. More particularly in the case of densely sintered thin-walled ceramic clay plates of large format this leads to undesired warping or so-called "winging."

In accordance with the German patent specification No. 1,143,429 an attempt is made to solve this problem in the case of a method for the continuous production of large area cladding or facing plates of ceramic material, which are provided with undercut members on the side opposite to the front side, using an extruder by extruding from the latter a strip having a somewhat lesser breadth and greater thickness than the cross-section of the eventual plate. This strip is subjected to a rolling operation while being continuously moved forward so as to be rolled to the prescribed breadth and thickness. Then on one of its side surfaces it is moved past cutting machining tools which undercut it and it is then subjected to a further rolling operation to shape it. The material is then cut to plates and the latter, after being dried, are fired while suspended.

Since this method did, however, not lead to complete success an attempt was made to improve it. In the German patent specification No. 1,708,877 there is the description of a method for the production of large area thin plates of ceramic material by extruding of a plastic ceramic composition from the die of an extruder. The strand is then rolled out to the desired final thickness. The strand, after leaving the die, is cut up in plates or moldings with a length corresponding to the breadth of the eventual product. These plates or moldings are rolled out in a direction perpendicular to the direction of emergence of the strand to the eventual or final thickness. It has been possible with this method to cancel out the orientation of the clay particles, which occurs on extrusion of the strand from the die of the extruder, partly by the step of rolling out the plates or moldings, produced from the strand after it has emerged from the die, in a direction perpendicular to the direction of emergence from the die of the strand, such rolling being to the final thickness.

In this case as well the plates are fired while hanging, something which is referred to more particularly in the German patent specification No. 1,571,475, in the case of which in a method for avoiding warping due to shaping and/or drying, on firing thin ceramic plates, which are dried after shaping and then fired, two respective plates are fired while suspended with surfaces adjacent to each other which are the same as regards the drying and/or shaping operation and, in the case of a preferred form of the method, the plates are mutually sealed or locked at the upper and lower ends in relation to each other.

Although the above mentioned methods of the prior art made it possible to come close to the aim of producing large area ceramic plates which are comparatively free of signs of warp, it was nevertheless found that a high percentage of the plates still suffered from slight warp despite taking all precautions. This warping made the plates unsuitable for cladding walls or floors so that they were rejected by customers owing to their excessive dimensional tolerances as regards flatness and owing to "winging." It has been found that these shortcomings made the profitability of production questionable. The previously described methods of attaining the basic aim, that is to say producing clay ceramic plates in large formats without warp are neither completely satisfactory in themselves nor do they make it possible, even when combined with each other, to avoid a comparatively high quota of useless plates.

DESCRIPTION OF THE PRESENT INVENTION

One aim of the present invention is that of proposing a method with which it is possible to attain the basic aim of producing clay ceramic plates with large formats and a low wall thickness without any warp in the final product.

The invention therefore is based on a method for the production of large format, densely sintered ceramic plates with a low wall thickness, in the case of which the ceramic composition is firstly extruded by means of an extruder as billets, following this the billets are rolled out in a direction perpendicular to the direction of extrusion to form plates and the plates, after they have been cut to the desired format, are dried and fired, characterised in that, in order to attain the basic aim of the invention, following the rolling out operation carried out in a direction perpendicular to the direction of extrusion, there is a further rolling out operation in the direction of extrusion of the billets and the cutting out to size of the plates to the desired format is carried out perpendicularly to the plane of the plate and with a pressing action.

Preferably, in accordance with a further development of the invention, the rolling out operation is carried out in two mutually perpendicular directions, the rolling preferably being two- to five-fold. In other words, the rolling out operation including transverse and extrusion direction rolling out is repeated from two to five times.

Owing to this multiple change in the direction of rolling out, which can also be considered as multivectoral rolling, in the case of which therefore the direction of rolling while being changed in each case with respect to the direction of rolling on the billet, nevertheless always remains parallel to the two main surfaces of the billet, structures due to pressing, and which cannot be avoided during the pressing operation, are more especially so substantially cancelled out, that for this reason there is no possibility of winging of the fully fired plates occurring.

Furthermore on carrying out multivectoral rolling a felting of the clay particles in the molding occurs so that compaction is made more even. It has been found that these measures lead to a uniform drying behaviour without any shrinkage and other problems and furthermore the final strength of the plates is enhanced.

A further consequence of the evened out compaction during and due to the multivectoral rolling is that the well-known partial swelling of the clay ceramic molding, which is to be considered as a partial elastic resiliency effect of the composition, is compensated for. The surface of a plate molding rolled out using multivectoral rolling is smoothed out to a very large extend by the felting of the clay particles and this again leads during the later firing process to a comparatively intense sintering of the surface with corresponding mechanical properties.

The multivectoral rolling is of substantial importance owing to the above mentioned additional characteristics for further technological processing and as regards the quality of the final product.

It is, however, of substantial importance that the cutting out of the plates to the desired format be carried out perpendicular to the plate plane and with a compressing cut. This type of cutting has previously not has any attention paid to it to any practical extent. It has, however, been found that every cutting operation, which has even the very least component tending in one direction of the plate plane leads to a distortion of the structure of the ceramic composition at the cutting surface in a direction, which necessarily later leads to winging of the fired plate. It is only due to the fact that, in accordance with the invention, the cutting off of excess material is carried out in a direction perpendicular to the support plane of the plate that it is possible to ensure that all orientation which may be produced by this cutting operation is effective in a direction perpendicular to the plate plane and therefore there is no component, which could lead to any sort of winging warp of the plate.

Preferably the cutting out to shape of the plates is carried out using an electrically acting or electrically dissolving cutting knife. Cutting with an electric action on the shaping of ceramic moldings is known as such. The use of this principle by employing electrically acting cutting knives in conjunction with the compressive cutting perpendicular to the plate plane leads to a further prevention of orientation of the particles of the ceramic composition in undesired directions and accordingly avoids any winging of the final product with an even greater degree of reliability.

The success of the method in accordance with the invention can be even further enhanced if, in accordance with a further embodiment of the invention, the extrusion of the ceramic composition to billets is carried out using a piston-type extruder.

As compared with generally conventional screw extruders a piston-type extruder does not produce any twist and furthermore does not produce any helical structures in the extruded composition strand. It is, however, specifically helical structures, which even if only present to a slight extent have been found to lead to later deformation of plates owing to the "memory" of the composition.

The following drying and the glazing of the moldings is carried out respectively in accordance with well-known methods as are familiar to those skilled in the art. The drying of large format, thin walled moldings, which normally, just like firing, leads to problems of deformation, does not offer any difficulties in the case of the method in accordance with the invention more especially owing to the multivectoral rolling.

In the case of the method in accordance with the invention it is also to be recommended to drie the plates while suspended. The advantages of such firing of the plates while they are hanging can be found described in the patent specifications mentioned above and it is therefore only reasonable to use these advantages in the present case as well in order not to sacrifice the avoidance of structures in the plate body as ensured by the rolling and cutting method in accordance with the invention, by an unsuitable firing method.

Another possibility of firing plates produced and cut to size in accordance with the invention, resides in that the plates are placed on the smooth surface of a firing truck and are then subjected while supine to the firing operation. This can be more particularly of importance if the plates are to be glazed and it is desired to avoid draining away of the glaze during firing, something which would lead to undesired patterning of the plate surface.

In the case of every operation for firing the plates in a horizontal position the problem, however, arises of ensuring exactly the same temperature conditions on the top and bottom sides of the plate lying on the truck platform in order to avoid secondary warping on sintering, such warping being due to temperature stresses.

This requirement can be fulfilled in accordance with a further development of the invention as regards the formation of a build-up of heat on the support surface. In this respect the underlying support is conveniently made in such a manner that, in the case of a thickness of for example 15 cm for a plate of a size of 1 × 1 meter on glazing firing it has a thermal resistance of at least 0.4 K/W or more. In this respect K = °K and W = Watt. The purpose of this measure is not to insulate the lower part of the kiln against heat losses or, respectively, to prevent an excessive temperature rise in the lower part of the kiln, and instead it is intended to prevent secondary warping, more particularly owing to the formation of a heat build-up directly under the tabular material to be fired. For this purpose refractory materials which tend to build up heat are suitable. By increasing the thermal resistance of the upper support surface of the truck platform from that heretofore provided, the temperature difference or thermal gradient between the upper and lower surfaces of the plate is reduced. This reduction in thermal gradient substantially reduces or eliminates warping of the ceramic plate during the firing operation.

The embodiments of the invention in which an exclusive property or privilege is claimed are as follows:

1. A method of producing large format, densely sintered thin walled ceramic plates, comprising the steps of:

extruding a ceramic composition by means of an extruder to form a billet;

rolling out the billet in a direction generally perpendicular to the direction of extrusion;

rolling out the billet in the direction of extrusion after said perpendicular rolling out to form a thin walled plate;

cutting the plate with a knife with a pressing action perpendicular to the plane of the plate to form a plate of a desired size and format; and drying and firing said plate.

2. A method as defined by claim 1 wherein said rolling out in a direction perpendicular to the direction of extrusion and then in the direction of extrusion is repeated from two to five times.

3. A method as defined by claim 1 wherein said knife is an electrically acting cutting knife.

4. A method as defined by claim 1 wherein said extruder is a piston-type extruder.

5. A method as defined by claim 1 wherein said plates are fired while suspended.

6. A method as defined by claim 1 wherein said firing step includes:

resting said plate on a horizontal support, said support having a thermal resistance to create a strong heat buildup layer directly under the plate to thereby decrease the temperature gradient between the upper and lower surfaces of the plate.

7. A method as defined by claim 6 wherein the thermal resistance of the support is at least 0.40 K/W.

* * * * *